US005297353A

United States Patent [19]

Ghalayini

[11] Patent Number: 5,297,353

[45] Date of Patent: Mar. 29, 1994

[54] MULTIVISION INTERMITTENT DISPLAY

[76] Inventor: Faouzi M. Ghalayini, 250 Sandhurst Rd., Columbia, S.C. 29210

[21] Appl. No.: 698,975

[22] Filed: May 13, 1991

[51] Int. Cl.[5] ..... G09F 11/02; G09F 13/12

[52] U.S. Cl. ..... 40/503; 40/502; 40/219

[58] Field of Search ..... 40/502, 503, 506, 493, 40/219, 900, 473, 467

[56] References Cited

U.S. PATENT DOCUMENTS

| | | | |
|---|---|---|---|
| 202,325 | 4/1878 | Bostock et al. | 40/473 |
| 2,075,245 | 3/1937 | Van Schuck | 40/473 |
| 2,079,303 | 5/1937 | Pinner | 40/473 |
| 2,510,409 | 6/1950 | McPhaul | 40/467 |
| 2,565,575 | 8/1951 | Rosenthal | 40/219 |
| 4,381,616 | 5/1983 | Saxer | 40/503 X |
| 4,638,580 | 1/1987 | Gianetti et al. | 40/503 |
| 5,003,716 | 4/1991 | Dyar | 40/503 |

*Primary Examiner*—Kenneth J. Dorner
*Assistant Examiner*—J. Bonifanti
*Attorney, Agent, or Firm*—Cort Flint

[57] ABSTRACT

A display is disclosed which produces multiple visual displays in an intermittent manner which includes a display housing having a perimeter wall which is transparent during visual display and is an opaque mirror between visual displays. The perimeter wall of the display housing is a composite structure which preferably includes a transparent cylindrical substrate which is coated with an optical film and an opaque mask which defines display windows. Multiple visual displays are produced by a rotating display base which carries rows of rotating display elements. Preferably, the display elements are elongated triangular elements having three image faces which bear images which create the visual displays. The triangular display elements are arranged in a triangular configuration wherein the rows intersect one another at acute angles and are carried by the rotating base. The rotating base includes three display positions and each of the triangular elements includes three display positions. A stationary observer would see nine different visual displays and may see themselves mirrored in between and during the changes of visual displays. The perimeter wall of the display housing becomes transparent as the triangular display elements are backlit along their entire length by elongated fluorescent or neon light tubes. When the light tubes are off, the cylindrical display housing is an opaque mirror, preferably, about its entire periphery and height. Other embodiments of the invention include a single row of triangular display elements, and a rotating display base which includes display faces consisting of only a single display element.

25 Claims, 5 Drawing Sheets

Fig. 7.
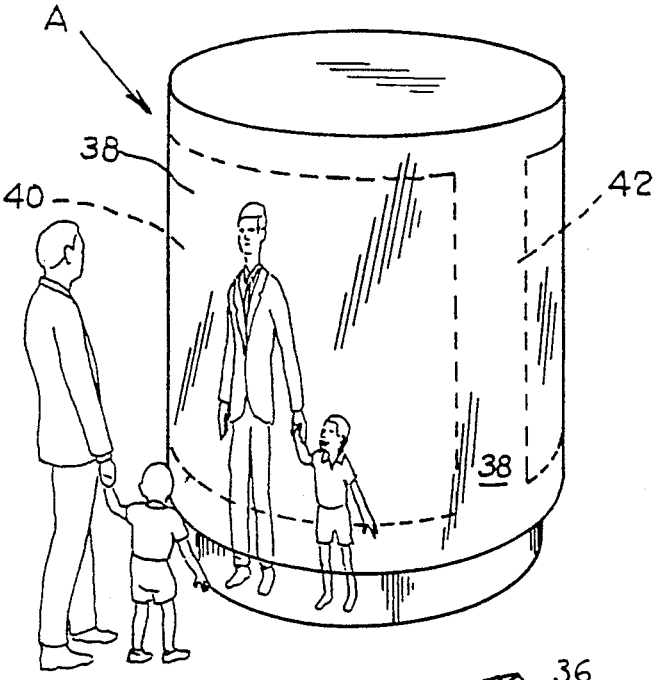
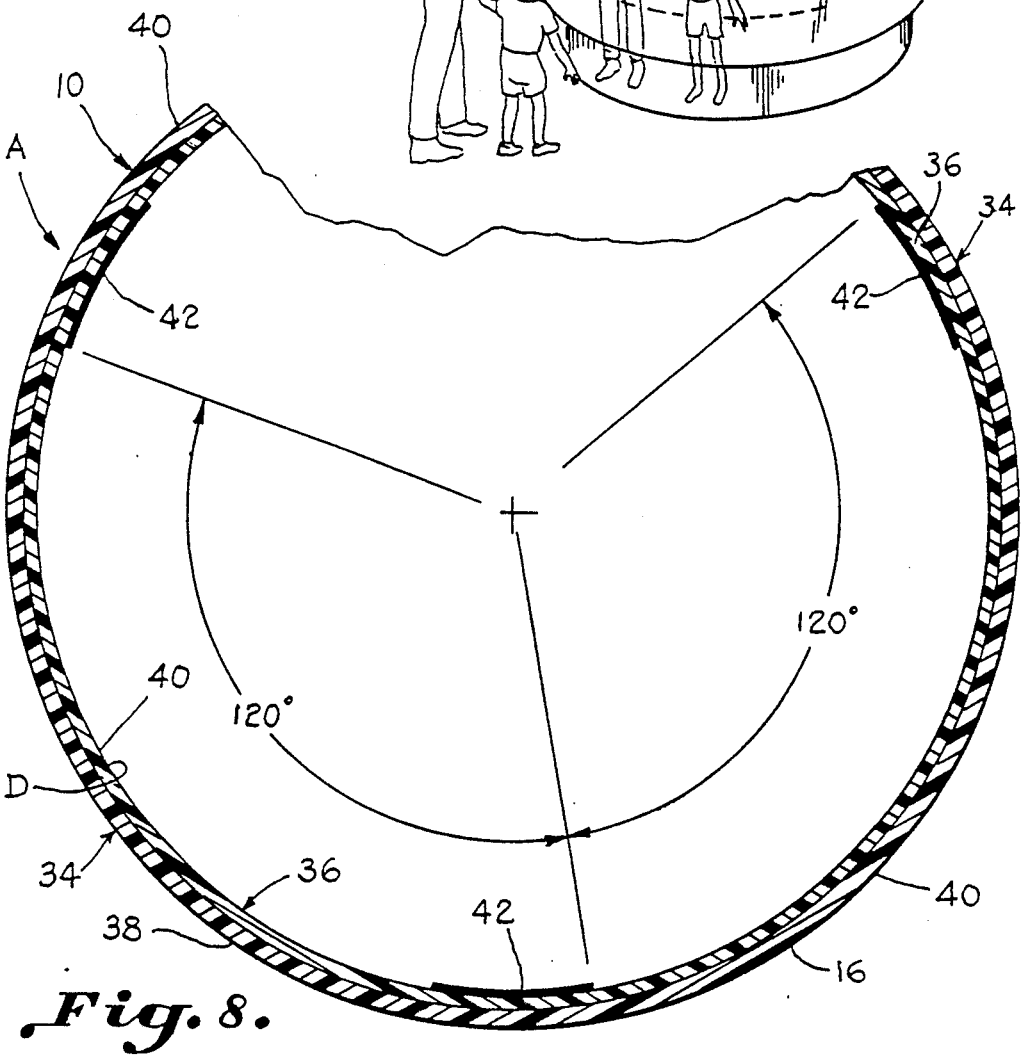
Fig. 8.

MULTIVISION INTERMITTENT DISPLAY

BACKGROUND OF THE INVENTION

The invention relates to a lighted display sign, and more particularly, to such a display producing multiple visual displays through a transparent wall which is a mirror between changes of the displays.

Heretofore, visual displays for advertising and the like have been provided having a single display face which changes. U.S. Pat. No. 4,021,946 discloses a sign display including a plurality of upstanding pyramids which rotate to provide a single, changeable display face. U.S. Pat. Nos. 3,273,271, 4,528,763, and 4,987,691 disclose similar changeable displays which comprise elongated pyramid elements with three faces. While the displays are changeable, the number of displays produced is limited. U.S. Pat. No. 3,717,942 discloses a five-sided display with different images that change. It is also known to provide displays having screens with layers of non-uniform optical densities whereby back lighting of the screens makes the screens transparent for the different messages or objects displayed while leaving the screen uniformly reflective of environmental light in an off condition.

While the above displays are suitable for their intended purposes, none of the displays provide a suitable display for a producing a large number of visual displays in a highly attractive manner which attracts observers and retains their attention sufficiently while the display cycles through and produces multiple visual displays.

Accordingly, an object of the invention is to provide a highly attractive display which produces multiple visual displays over a prescribed display cycle.

Another object of the invention is to provide a display which produces multiple visual displays in an intermittent manner where the displays are visible through a transparency during a prescribed viewing time and the transparency is a mirror during display changes.

Another object of the invention is to provide a display for producing multiple visual displays which includes rotating display elements carried on a rotating base whereby multiple visual displays are produced on multiple display faces within a display housing which is transparent for viewing the visual displays, but is an opaque mirror while the visual displays are changing.

Another object of the invention is to provide a highly attractive display which produces a multiple visual display, yet requires a minimum of floor space.

Another object of the invention is to provide a highly attractive display requiring a minimum of floor space which includes a cylindrical housing which is transparent for viewing multiple visual displays and is an opaque mirror while the visual displays change wherein the cylindrical housing provides a plurality of display faces around its periphery which alternately change between visions and mirrors in a highly attractive manner.

SUMMARY OF THE INVENTION

The above objectives are accomplished according to the present invention by providing a multivision display which produces a plurality of visual displays in an intermittent manner. The display includes a display housing having a cylindrical perimeter wall which cycles between transparency and an opaque mirror as the displays change and are backlit. A rotating display base is carried within the display housing which has a plurality of display positions. A plurality of display faces are carried by the rotating triangular display base. Each of the display faces include a plurality of rotating display elements which have a plurality of display positions. A plurality of image faces are carried by the rotating display elements having images which create the visual displays at the display positions. Illumination devices are carried within the display housing for illuminating and backlighting the display faces. An illumination switch is provided for switching the illumination devices between on and off states. The perimeter wall of the display housing includes a composite structure composed of a transparent cylindrical substrate coated with an optical film. The film is masked with an opaque paint to define display windows. The composite wall structure is transparent when the illumination devices are on, and is an opaque mirror when the illumination devices are off. Thus, the visual displays can be seen from the exterior of the display housing only when the display faces are illuminated and backlit. A drive is provided for independently rotating the display base and the display elements to display positions in synchronization with one another so that multiple visual displays are produced at each of the display faces as the display elements and the display base rotate independently. A control device controls the drive and the illumination switches. Preferably, the display base forms a triangular display having three display faces lying in planes which intersect each other at acute angles. The display elements include vertical elongated triangular display elements having a hollow interior. The hollow interior of the triangular elements is defined by three intersecting interior walls, and truncated corners formed at the apexes of the intersecting interior walls reduce reflection. The interior walls of the triangular display elements are texturized to evenly disperse light. The elongated triangular elements are extruded from acrylic. The triangular display elements are arranged in rows having first and second ends. A triangular space is formed between the end display elements of adjacent rows of display elements facilitating rotation of the end display elements. The illumination devices include a vertically extended illumination lamp carried within the interior of the triangular display elements which backlights the display faces of the triangular display elements. Preferably, the illumination devices are elongated fluorescent or neon light tubes extending generally the entire length of the triangular display elements. The control device includes a sensor for detecting the position of the rotating display base and the rotating display elements and for generating sensor signals when the display base is rotated to a first plurality display positions and when the display elements are rotated to a second plurality display positions. The control turns the base drive off in response to the first signal, and switches the light tubes on. A timer switches the light tubes off and turns the display element drive on after a prescribed time period and then rotates the display elements to another display position. This cycle is repeated until all of the second plurality of display positions have been reached. Then, the control turns the base drive on and rotates the display base to another of said first plurality of display positions. This cycle is repeated until all the visual displays have been produced at all the display faces. If the display elements have N faces, the control includes a display cycle in which multiple visual displays are produced during one complete rotation of the display base and N complete rotations of the display elements. For example, if the display base has $N_1$ display positions, and the display elements have $N_2$ display positions, then $N_1 \times N_2$ visual displays are produced. Where the display base carries three rows of triangular display elements, there are nine intermittent visual displays produced ($3 \times 3$) in a complete display cycle. Between each display, the cylindrical display housing is an opaque change. An observer may see his own reflection during display changes.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein:

FIG. 7 is a perspective view illustrating a cylindrical display housing according to the invention between display changes where the cylindrical housing presents an opaque mirror to an observer;

FIG. 8 is a cross-section of a cylindrical display housing according to the invention having a composite wall structure which includes a transparent cylinder, optical film coating, and mask coating according to the invention.

DESCRIPTION OF A PREFERRED EMBODIMENT

Figure 9:
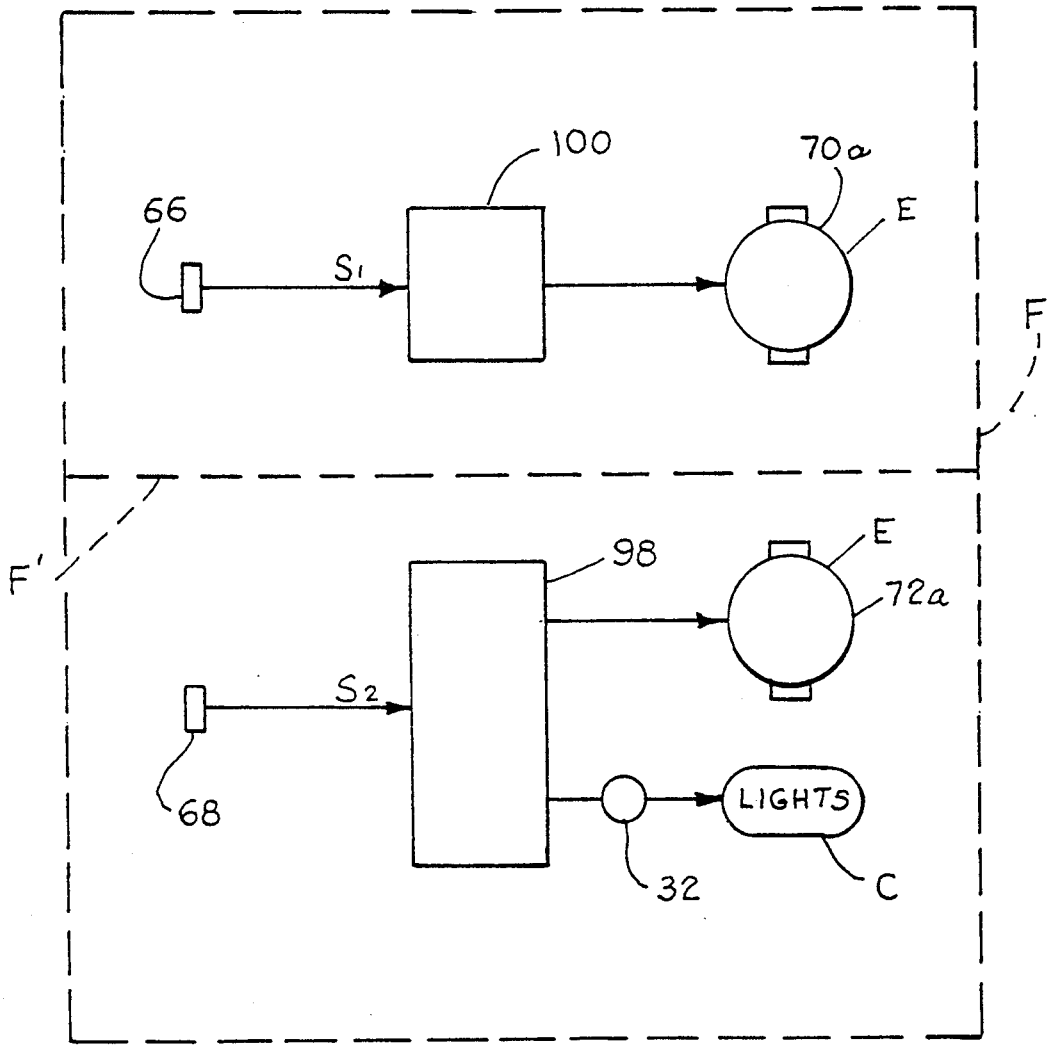
FIG. 9 is a schematic diagram of a control circuit for a multivision intermittent display according to the invention.

Referring now in more detail to the drawings, a multivision display is illustrated generally at A for producing a plurality of visual displays in an intermittent manner comprising a display housing 10 having an interior 12 and an exterior 14, and a composite perimeter wall 16 surrounding the periphery of the display housing. A rotating display base 18 is carried within display housing 10 having a plurality of display positions. A plurality of display faces 20, 22, and 24 are carried by rotating display base 18. Each of the display faces includes a plurality of rotating triangular display elements B having a plurality of display positions. A plurality of image faces 26, 28, and 30 are carried by rotating display elements B having images which create visual displays at the display positions of display base 18 and said display elements B. Illumination means C is carried within display housing 10 for illuminating display faces 20, 22, and 24. The illumination means have an on state and an off state which is controlled by an illumination switching means 32 (FIG. 9).

Perimeter wall of display housing 10 includes optical means D which renders at least portions of the wall transparent when illumination means C is in the on state, and renders the perimeter wall an opaque mirror when the illumination means is off. Visual displays can be seen from the exterior of display housing 10 only when the display faces are illuminated and backlit. Display housing 10 includes a transparent cylinder 34 cast or extruded from a plastic material selected from acrylic or polycarbonate. For this purpose, the composite structure includes a mask means 42, which may be an opaque paint, for rendering portions of the transparent cylindrical wall other than display windows 40 generally opaque when illumination means C is in the on state. Mask 42 defines three display windows 40 when the display faces are back-lit spaced generally 120 degrees around the interior periphery of cylindrical wall 16. Reflective coating 36 may be any suitable mirror coating such as Llumar Window Film (R-20CDF) manufactured by Martin Processing, Inc. of Martinsville, Va. That reflective film has a visible light transmittance of about 15 percent which provides a highly reflective mirror when lights C within the display housing are off, and a high degree of transparency when backlit. Preferably, perimeter wall 16 of said display housing is cylindrical and includes a composite structure which includes transparent cylinder 34 as a substrate, and optical means D, which may include a reflective coating or film 36, as can best be seen in FIG. 8. Reflective coating 36 makes the composite structure an opaque mirror 38 on exterior 14 of display housing 10 when illumination means C is in an off state and produces transparent display windows 40 in display housing 10 through which the visual displays are seen when the illumination means is in the on state.

Figure 1:
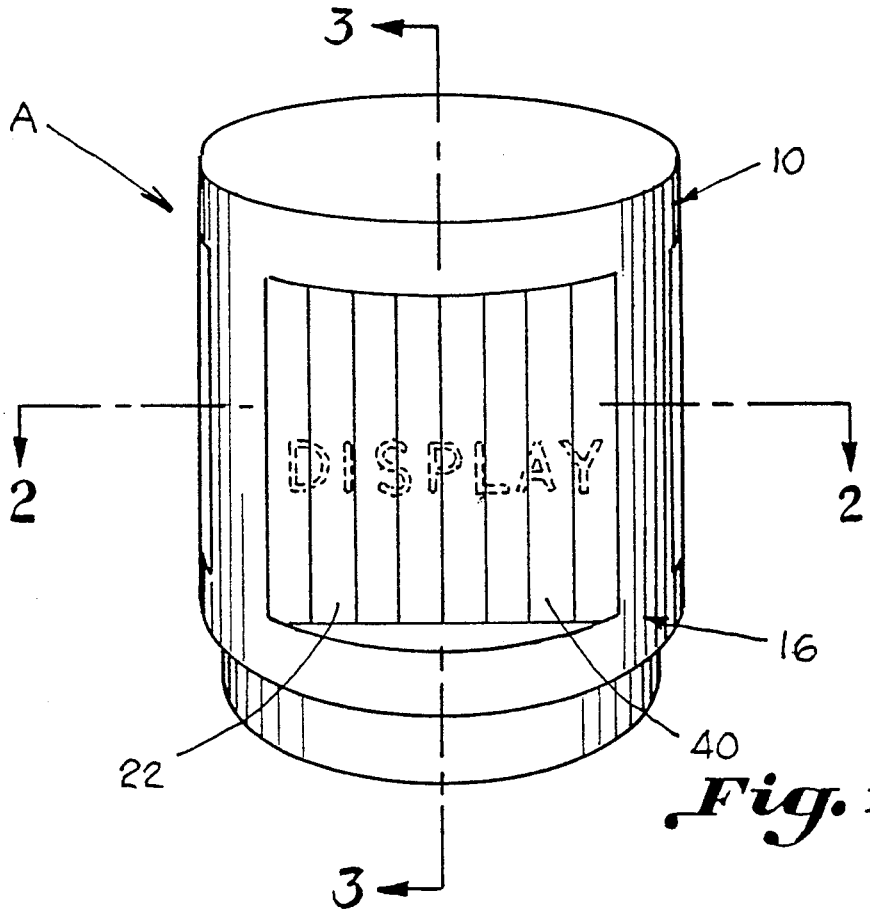
FIG. 1 is a perspective view illustrating a cylindrical display housing according to the invention.
Figure 2:
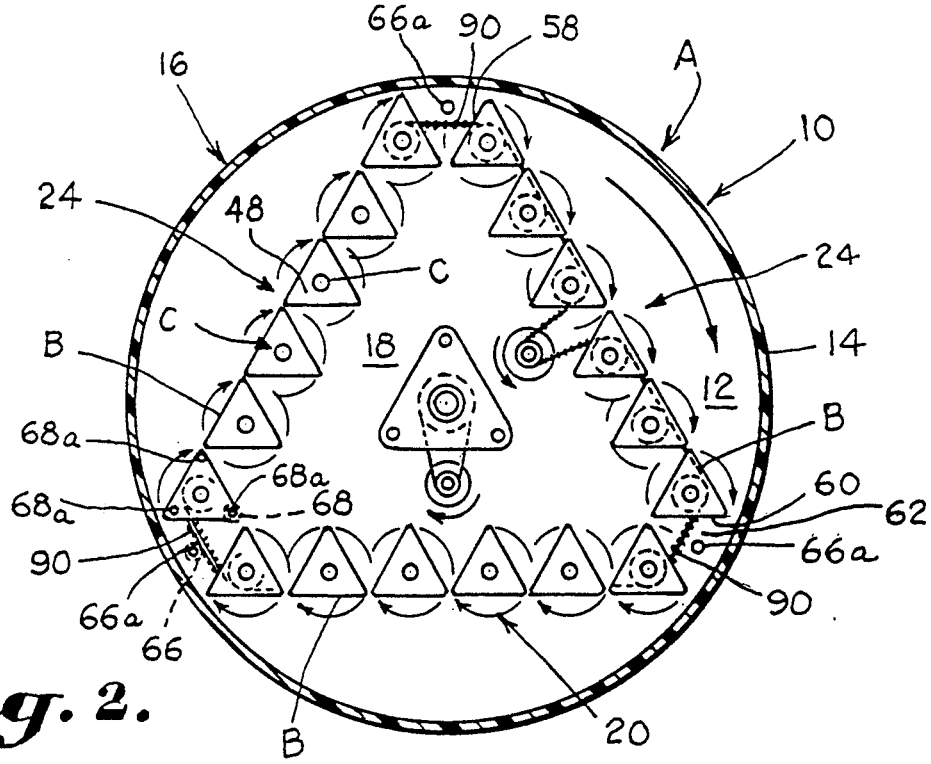
FIG. 2 is a sectional view taken along line 2—2 of FIG. 1.
Figure 6:
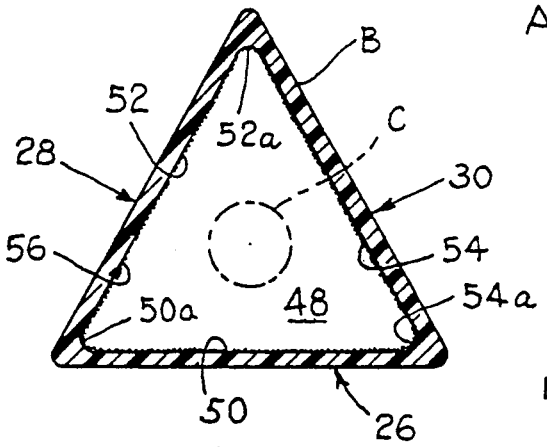
FIG. 6 is a cross-section of a triangular display element according to the invention.

As can best be seen in FIGS. 2 and 6, display faces 22, 24, and 26 form a triangular display having three display faces lying in planes which intersect each other at acute angles. Display elements B include vertical elongated triangular display elements having a hollow interior 48. The hollow interior is defined by three intersecting interior walls 50, 52, 54, and truncated corners 50*a*, 52*a*, 54*b* formed at the apexes of the intersecting interior walls to reduce reflection. The interior walls of triangular display elements B are texturized at 56 to evenly disperse light. Preferably, elongated triangular elements B are extruded from acrylic. As can best be seen in FIG. 2, display faces 22, 24, 26 include rows of triangular display elements B having first and second ends 58 and 60. There, a triangular space 62 is formed between the end display elements of adjacent rows of display elements facilitating rotation of the end display elements.

Preferably, illumination means C includes vertically extending illumination means carried within interior 48 of the triangular display elements which illuminates display faces 26, 28, 30 of triangular display elements B. The illumination means may include elongated light tubes 64 extending generally the entire length of the triangular display elements which may be rapid start fluorescent tubes or neon tubes, as can best be seen in FIG. 3. As can best be seen in FIGS. 3 and 9, there is a drive means, designated generally as E, for independently rotating display base 18 and display elements B to display positions in synchronization with one another so that multiple visual displays are created at each of display faces 22, 24, 26.

Control means, designated generally as F, control drive means E and illumination switching means 32. The control means includes a sensor means for detecting the position of rotating display base 18, and rotating display elements B for generating a first signal $S_1$ when the display base is rotated to a display position, and a second signal $S_2$ when the display elements are rotated to a display position. Preferably, the sensor means includes a first sensor means 66 for detecting the position of rotating display base 18, and a second sensor means 68 for detecting the position of rotating display elements B. Preferably, drive means E includes a first drive means 70 for rotating display base 18, and a second drive means 72 for rotating display elements B.

Figure 3:
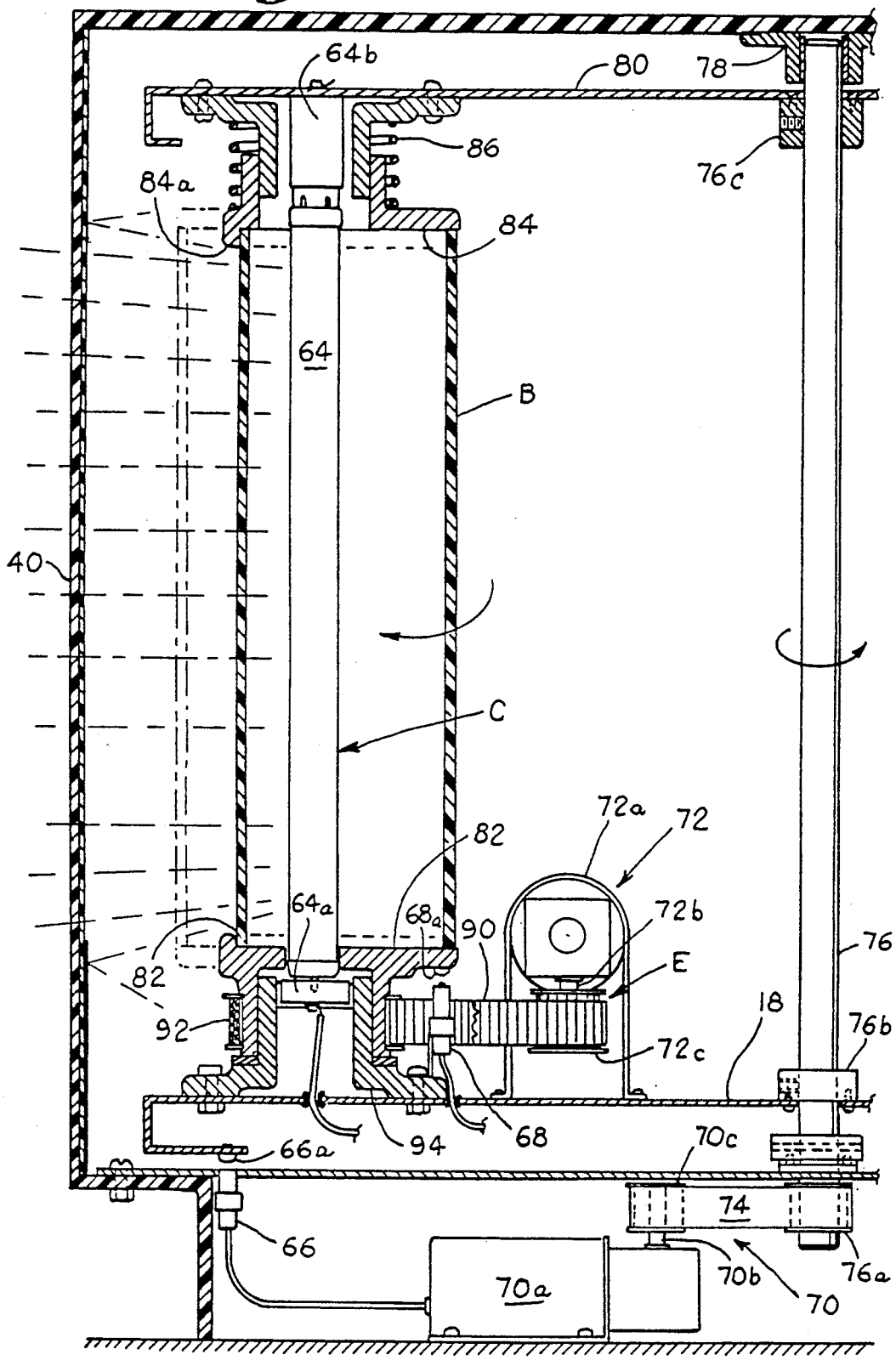
FIG. 3 is a sectional view taken along line 3—3 of FIG. 1.

As can best be seen in FIG. 3, first drive means 70 includes a drive motor 70*a* having an output shaft 70*b* with a drive pulley 70*c* which drives a timing belt 74. Belt 74 drives a vertical shaft 76 through a drive pulley 76*a* affixed thereto. Vertical shaft 76 is affixed to base 18 by a coupling 76*b*. An upper end of shaft 76 is journaled in a coupling 78 and is affixed by a coupling 76*c* to an upper plate 80. Triangular elements B extend between base 18 and upper plate 80. Lower ends of triangular elements B are carried on a rotating base 82 which is preferably triangular and includes a triangular lip 82*a* which retains the base of triangular elements B. An upper end of triangular elements B is similarly disposed within a triangular plate 84 and lip 84*a* and may be releasingly engaged between triangular base 82 and plate 84 by means of a resilient coupling provided by a coil spring 86. Light tubes 64 extend between a lower socket 64*a* and upper socket 64*b*, and are stationary as triangular elements B rotate. Second drive means 72 for rotating triangular elements B includes a drive motor 72*a* having an output shaft 72*b* and having a pulley 72*c* affixed thereto. A timing belt 90 is driven by drive motor 72*a*. Lower bases 82 of rotating triangular elements B include gear teeth 92 which mesh with timing belt 90 to rotate the elements. Drive motors 70*a* and 72*a* are preferably small horsepower gear motors which can be driven in steps. As can best be seen in FIG. 2, timing belt 90 passes around the outside of all of the rotating triangular elements B and meshes with timing gear teeth on the hubs of the lower rotating bases 82. Sensor means for detecting whether display base 18 and display elements B are in a displayed position includes sensors 66 and 68. Sensor 66 includes a suitable proximity sensor such as an Inductive Proximity Sensor manufactured by Omron Electronics, Inc. of Schaumbuorg, Ill. Sensor 66 detects an iron screw 66*a*, of which there are three spaced eqiangularly around the periphery of rotating base 18. Sensor 66 is stationary and generates a signal $S_1$ each time an iron screw 66*a* is rotated in proximity to sensor 66. Likewise, sensor 68 may be a suitable inductive proximity sensor which senses the presence of three iron screws 68*a* carried at the apex and eqiangularly of triangular base 82. Sensor 68 may be mounted to a stationary flange 94 about which rotating base 92 rotates (FIG. 3). The sensors 66 and 68 provide alignment means for aligning image faces 26, 28, 30 at display faces 20, 22, 24 during a display cycle.

Control means F includes a complete display cycle which a display base cycle and a display element cycle. The cycles may be controlled in any suitable manner such as by time based controls, mechanical and counter controls, sensors, or combinations thereof, as are well within the purview of those skilled in the art of automatic or programmed controls. An example of display cycles for the preferred embodiment where there are three display positions for display base 18 and three independent display positions for display elements B will now be described, it being understood that other control sequences may be had depending on the application being made, and the number of display positions. The display element cycle includes the following control events:

(1) turning illumination means C after rotation of display base 18 to a display position and rotation of display elements B to a first display position, (2) turning illumination means C off after a prescribed time period, rotating display elements B to a second display position, and generating a signal $S_2$, (3) turning on illumination means C in response to signal $S_2$, (4) turning illumination means C off after a prescribed time period, and rotating display elements B to a third display position, and generating a signal $S_2$, (5) turning on illumination means C in response to signal $S_2$, and (6) turning illumination means C off after a prescribed time period, and rotating display elements B to the first display position, and generating a signal $S_2$.

The display element cycle is repeated after each display base cycle. The display cycle may include the following control events:

(1) rotating display base 18 to a first display position and generating a first signal $S_1$, (2) after a first display element cycle, rotating base member 18 to a second display position and generating a second signal $S_1$, (3) after a second display element cycle, rotating display base 18 to a third display position and generating a third signal $S_1$, and (4) after a third display element cycle, rotating display base 18 to its first display position.

In the illustrated control system, the events are controlled by time, and separate control circuits are used for the display base and display elements. Signal S2 may be used to initiate an "on" time delay for energizing all of the illumination means C and an "off" time delay for element drive motor 72*a* for the time delay, and signal S1 may be used to initiate an "off" time delay for base motor 70*a* sufficient to enable completion of a display element cycle. For this purpose, control means F includes a timer means 98 for switching illumination means C to an on state and second drive 72*a* off for a prescribed time period during a display. The display elements B are then rotated to another display position and sensor 68 generates another sensor signal $S_2$. Timer means 98 may be any suitable motor timer such as a motor timer manufactured by Omron Electronics, Inc. which has an adjustable on delay and off delay. For example, control means F may switch illumination means C on for four seconds in response to a sensor signal $S_2$. The display time may be set to any prescribed time period by adjusting the on delay of timer 98. Preferably, the display time may be set for four seconds followed by an off delay time of two seconds. Therefore, display elements B have an eighteen second cycle. Control means F may include a second timer 100 which turns first drive 70*a* on after each display element cycle, i.e. eighteen seconds, and rotates display base 18 to another display position. Display elements may have N faces and control means F includes a display cycle wherein multiple visual displays are produced which includes a complete rotation of display base 18 and N complete rotations of display elements B. Display base 18 has $N_1$ display positions, display elements have $N_2$ display positions, and $N_1 \times N_2$ visual displays are produced. Where $N_1$ and $N_2$ are three, as in the preferred embodiment, nine visual displays are produced during a complete display cycle at display faces 20, 22, and 24.

Figure 4:
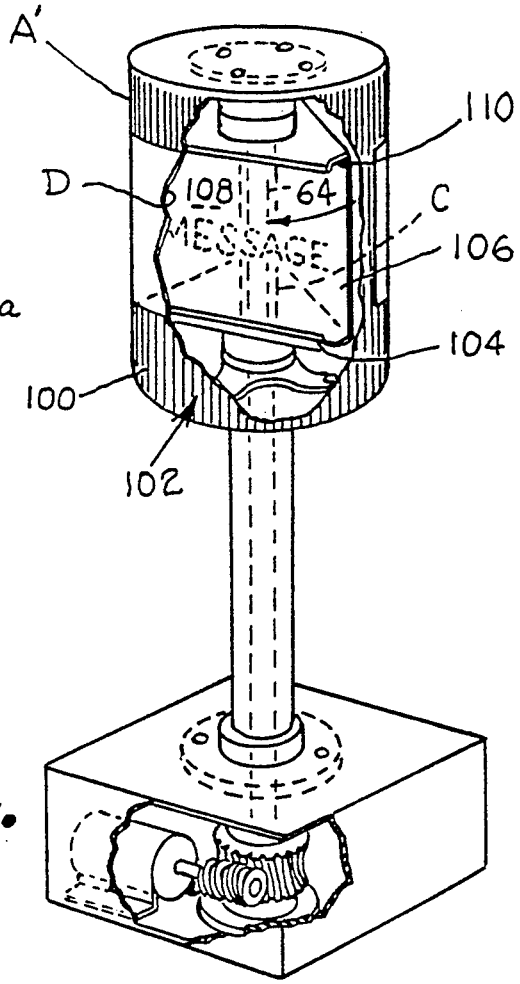
FIG. 4 is a perspective view illustrating an alternate embodiment of the present invention.

FIG. 4 illustrates another embodiment of the invention wherein a multivision display A' produces a plurality of visual displays in an intermittent manner comprising a display housing 100 having an interior and an exterior. The display housing has a perimeter wall 102 surrounding the periphery of the display housing. A rotating display base 104 is carried within a display housing having a plurality of display positions. A plurality of display faces 106, 108, 110 are carried by the rotating display base. Illumination means C are carried within the display housing for illuminating the display faces. The illumination means has an on state and an off state. Perimeter wall 102 of the display housing includes a composite structure 34 and optical means D which renders at least a portion of the wall transparent when the illumination means is in an on state, and which renders the wall an opaque mirror when the illumination means is in an off state. Drive means 112 independently rotates display base 104 and the display faces to multiple display positions so that multiple visual displays are created relative to a stationary observer as the display base rotates. A control means F' may control the drive means and the illumination switching means (FIG. 9). The control means may include a sensor for detecting the position of the rotating display base and generating a signal when the display base is rotated to a display position like base 18 and sensor 66. The control means includes a display cycle which terminates rotation of the display base in response to the sensor signal and switches the illumination means to an on state, and switches the illumination means off and rotates the display base to another display position after a prescribed time period. This cycle repeats until the display base has been rotated to all of the display positions.

Figure 5:
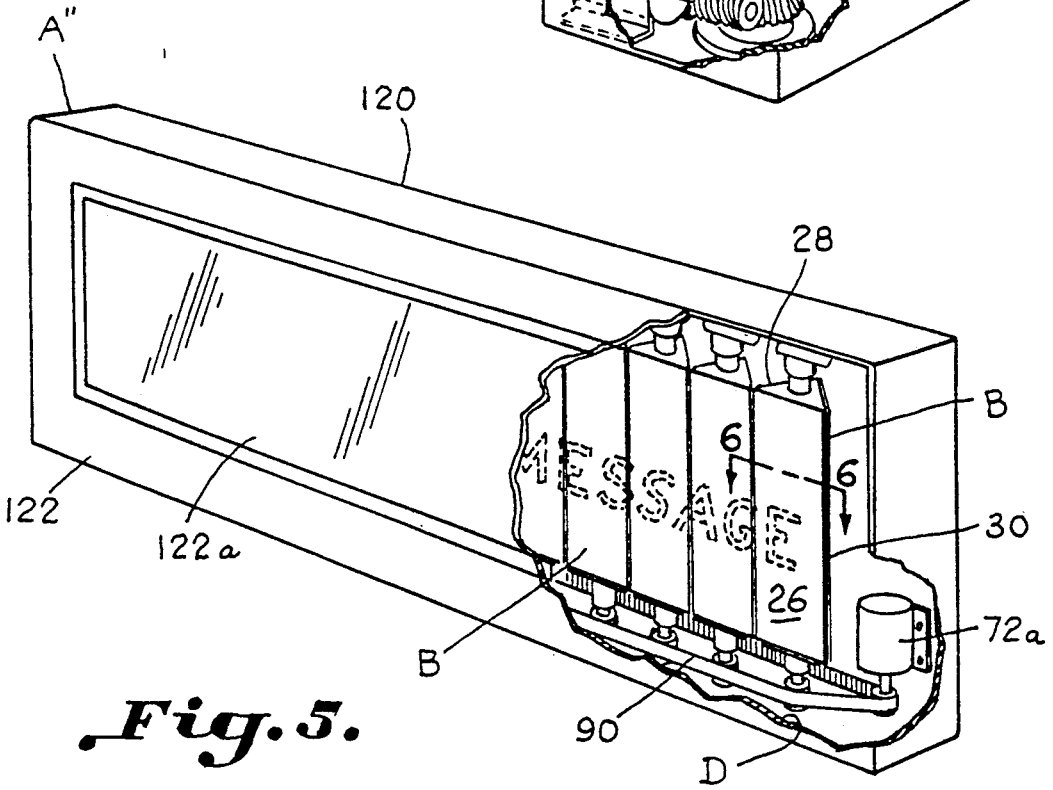
FIG. 5 is a perspective view illustrating another alternate embodiment of the present invention.

FIG. 5 illustrates another embodiment of the invention wherein a multivision display A" is illustrated having a single row of triangular display elements B. A display housing 120 includes an interior in which triangular display elements B are placed, and an exterior having a display wall 122. Display wall 122 includes a composite structure wherein at least a portion includes a transparent substrate and optical means D for rendering the transparent substrate transparent when triangular elements B are backlit and rendering the transparent panel an opaque mirror when the illumination is off. Triangular elements B may be identical to those disclosed for display A, as can best be seen in FIGS. 2 and 3. Each triangular element includes an image face 26, 28, and 30 which bear images which display messages when the image faces of the rotating elements are aligned, as can best be seen in FIG. 5. Illumination means C is carried within the interior of each rotating element B as illustrated in FIG. 3. The control and display cycle of the display illustrated in FIG. 5 may be the same as a single display element cycle described in connection with the embodiment of display A. The alternate embodiments of FIGS. 4 and 5 will include only three visual displays, whereas the preferred embodiment of the invention produces nine visual displays. However, in some applications, the embodiments of FIGS. 4 and 5 may be advantageous.

While a preferred embodiment of the invention has been described using specific terms, such description is for illustrative purposes only, and it is to be understood that changes and variations may be made without departing from the spirit or scope of the following claims.

What is claimed is:

1. A multivision display for producing a plurality of visual displays in an intermittent manner comprising:

a display housing having an interior and an exterior, said display housing having a perimeter wall surrounding the periphery of said display housing;

a rotating display base carried within said display housing having a plurality of display positions;

a plurality of display faces carried by said rotating display base;

each of said display faces including a plurality of rotating display elements having a plurality of display positions;

a plurality of image faces carried by said rotating display elements having images which create visual displays at said display positions of said display base and said display elements;

illumination means carried within said display housing for illuminating said display faces, said illumination means having an on state and an off state;

said perimeter wall of said display housing including optical means for rendering at least a portion of said perimeter wall transparent when said illumination means is in said on state, and which renders said perimeter wall opaque when said illumination means is in said off state so that said visual displays can be seen from said exterior of said display housing only when said display faces are illuminated;

drive means for independently rotating said display base and said display elements to said display positions in synchronization with one another so that multiple visual displays are created at each of said display faces as said display elements rotate on said display base and said display base rotates independently; and control means for controlling said drive means and for switching said illumination means between said on and off states to produce intermittent visual displays.

2. The apparatus of claim 1 wherein said optical means renders said perimeter wall an opaque mirror when opaque.

3. The apparatus of claim 1 wherein said perimeter wall of said display housing includes a cylindrical wall, and optical means includes a transparent cylindrical wall and a coating carried on at least preselected portions of said wall which makes said cylindrical wall a mirror on said exterior of said display housing when said illumination means is in said off state and makes at least said portions of said cylindrical wall transparent when said illumination means is in said on state so that said visual displays are seen by said observer.

4. The apparatus of claim 1 wherein said perimeter wall includes a composite structure which includes a transparent substrate and optical means for making said composite structure an opaque mirror on said exterior of said display housing when said illumination means is in said off state and for making a transparent display window in said display housing through which said visual displays are seen when said illumination means is in said on state.

5. The apparatus of claim 4 wherein said composite structure includes a mask means for rendering portions of said transparent perimeter wall other than said display window generally opaque when said illumination means is in said on state.

6. The apparatus of claim 1 wherein said display faces form a triangular display having three of said display faces lying in planes which intersect each other at acute angles.

7. The apparatus of claim 6 wherein said display faces include rows of said triangular display elements having first and second ends, and a triangular space formed between the end display elements of adjacent rows of display elements facilitating rotation of said end display elements.

8. The apparatus of claim 1 wherein said display elements include vertical elongated triangular display elements having a hollow interior.

9. The apparatus of claim 8 wherein said hollow interior of said triangular elements is defined by three intersecting interior walls, and truncated corners formed at the apexes of said intersecting interior walls.

10. The apparatus of claim 8 wherein said interior walls of said triangular display elements are texturized to evenly disperse light.

11. The apparatus of claim 8 wherein said elongated triangular elements are extruded from acrylic.

12. The apparatus of claim 8 wherein said illumination means includes vertically extending illumination means carried within said interior of said triangular display elements which illuminates said display faces of said triangular display elements.

13. The apparatus of claim 12 wherein said illumination means includes elongated light tubes extending generally the entire length of said triangular display elements.

14. The apparatus of claim 1 wherein said control means includes alignment means for aligning said image faces of said display elements in said display positions.

15. The apparatus of claim 14 wherein said alignment means includes a sensor means for detecting the position of said rotating display base and said rotating display elements.

16. The apparatus of claim 15 wherein said control means includes a display cycle having a display element cycle which includes rotating said display elements to a display position and switching said illumination means on a prescribed number of times; and a display base cycle which includes rotating said display base to a display position a prescribed number of times with a display element cycle occurring at each of said display positions of said display base.

17. The apparatus of claim 16 wherein said drive means includes a first drive means for rotating said display base, and a second drive means for rotating said display elements; and said sensor means generates a first signal when said display base is rotated to a display position and a second signal when said display elements are rotated to a display position.

18. The apparatus of claim 17 wherein said control means turns said first drive on after a first preset time period and turns said first drive off in response to said first signal.

19. The apparatus of claim 18 wherein said control means switches said illumination means on in response to said second signal.

20. The apparatus of claim 19 wherein said control means switches said illumination means off and said second drive on after a second preset time period until said display element is rotated to another display position and said sensor means generates another of said second signals.

21. The apparatus of claim 20 wherein said control means turns said first drive on after a prescribed number of said visual displays have been produced at said display faces, and rotates said display base to another display position.

22. The apparatus of claim 14 wherein said display elements have N faces and said control means includes a display cycle wherein said plurality of visual displays are produced which includes a complete rotation of said display base and N complete rotations of said display elements.

23. The apparatus of claim 14 wherein said display base has $N_1$ display positions, said display elements have $N_2$ display positions, and $N_1 \times N_2$ visual displays are produced.

24. The apparatus of claim 1 wherein said display housing includes a transparent cylinder cast or extruded from a plastic material selected from acrylic or polycarbonate.

25. A multivision display for producing a plurality of visual displays in an intermittent manner comprising:

a display housing having an interior and an exterior, said display housing having a perimeter wall surrounding the periphery of said display housing;

a rotating display base carried within said display housing having a plurality of display positions;

a plurality of display faces carried by said rotating display base;

each of said display faces including a plurality of rotating display elements having a plurality of display positions;

a plurality of image faces carried by said rotating display elements having images which create visual displays at said display positions of said display base and said display elements;

illumination means carried within said display housing for illuminating said display faces, said illumination means having an on state and an off state;

said perimeter wall of said display housing including optical means for rendering at least a portion of said perimeter wall transparent when said illumination means is in said on state to define a plurality of display windows, and which renders said display windows opaque when said illumination means is in said off state so that said visual displays can be seen through said display windows from said exterior of said display housing only when said display faces are illuminated;

drive means for independently rotating said display base and said display elements to said display positions in synchronization with one another so that multiple visual displays are visible through said display windows as created at each of said display faces by the rotation of said display elements on said display base and said display base rotates independently; and control means for controlling said drive means to produce multiple visual displays at said display windows.

* * * * *